United States Patent [19]

Connellan et al.

[11] 3,988,849

[45] Nov. 2, 1976

[54] SIGNAL LAUNCHER

[75] Inventors: William J. Connellan, North Haven; Robert L. Hillberg, Cheshire, both of Conn.

[73] Assignee: Bellmore-Johnson Tool Co., Hamden, Conn.

[22] Filed: July 7, 1975

[21] Appl. No.: 593,470

[52] U.S. Cl. ..... 42/70 G
[51] Int. Cl.[2] ..... F41C 17/06
[58] Field of Search ..... 42/70 G

[56] References Cited

UNITED STATES PATENTS

| | | | |
|---|---|---|---|
| 908,982 | 1/1909 | Ely | 42/70 G |
| 953,279 | 3/1910 | Moore | 42/70 G |
| 3,081,998 | 3/1963 | Weiss | 42/70 G |

*Primary Examiner*—Charles T. Jordan
*Attorney, Agent, or Firm*—DeLio and Montgomery

[57] ABSTRACT

A pistol-type signal launcher having a spring-actuated hammer carrying the firing pin, a pivotally mounted barrel releasably retained in firing position by a plunger which is biased toward the barrel support cam by a spring which may also bias the trigger toward cocked position with the sear in engagement with the hammer base, and a dog suspended at a point in the breech in a position to prevent the sear from releasing the hammer when the launcher is aimed in any direction except upward at an angle of at least 45°, such upward aiming of the launcher causing the dog to swing by gravity out of the path of the sear, permitting the hammer to be fired.

4 Claims, 4 Drawing Figures

SIGNAL LAUNCHER

This invention relates to a pistol-type signal launcher having a frame with grip and breech portions, a pivotally mounted barrel, a spring actuated hammer carrying the firing pin, resilient means for retaining the barrel releasably in firing position and means biasing the trigger toward cocked position, together with a dog suspended at a point in the breech in a position to prevent the sear from releasing the hammer when the launcher is aimed in any direction except upward at an angle of at least 45°, such upward aiming causing the dog to swing by gravity out of the path of the sear permitting the hammer to be fired. The invention is shown herein as an improvement on the signal launcher disclosed in Findlay application Ser. No. 551,332, filed Feb. 20, 1975 and assigned to a common assignee, but it is believed to be applicable, as a safety device, to other firearms and the like intended to be fired upward.

The signal launcher disclosed in said application can be fired in any direction but a careful user will normally exercise due caution in aiming it and will keep in mind the fact that it is intended solely for projecting a flare or other signal upward, to a substantial height, for attracting attention in an emergency, as from a boat at sea. However, even a signal flare could seriously injure a person or property if fired point blank at such a target, accidentally or otherwise, and the present invention includes the provision of means to prevent the trigger, in its cocked position, from being pulled except when the launcher is aimed upward at an angle of at least 45° as it should be for the proper launching of a flare or other signal.

Mechanisms are known wherein gravity actuated means will prevent a gun from being fired except when it is aimed almost horizontally, in order to counteract the alleged tendency of soldiers to overshoot the enemy. Edwards U.S. Pat. No. 2,476,138 shows a spring-powered toy gun wherein four swinging dogs are arranged to arrest movement of a plunger when the gun is aimed in any direction except straight up. Weiss U.S. Pat. No. 3,081,998 shows another toy gun with two pendulum stops which prevent "firing" when the gun is pointed too high or too low.

It is an object of the present invention to provide a single gravity responsive dog adapted to hold the sear in engagement with the hammer, in cocked or safety position, except when the launcher is aimed upward.

It is a further object of the invention to provide a safety device of the character described which is of the simplest possible construction, requiring modification of known flare launchers by the addition of only one moving part with minimal alteration of other elements.

It is another object of the invention to provide certain improvements in the form, construction and arrangement of the several parts whereby the above-named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawing, wherein.

Figure 1:
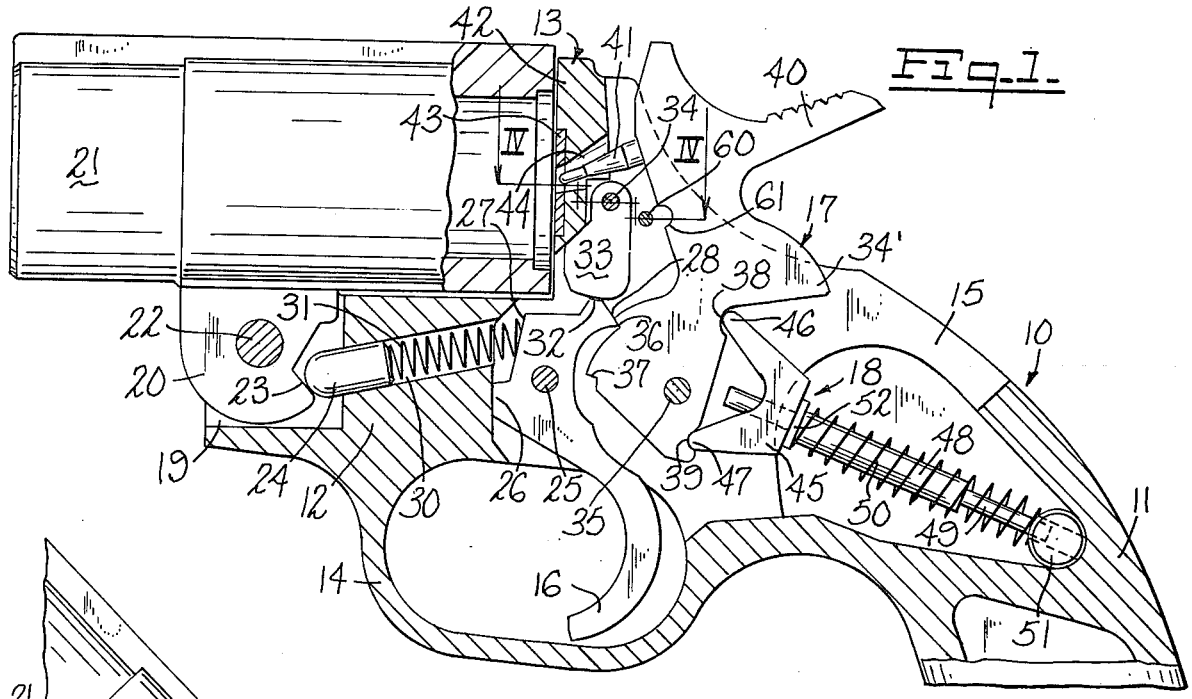
FIG. 1 represents a vertical medial section through the signal launcher, parts being in elevation, part of the butt being broken away, and the moving parts being in "safety" position.

Referring to the drawing, the launcher has a frame 10 which includes the grip portion 11, the barrel mounting portion 12, the breech portion 13 and the trigger guard 14. The frame is centrally recessed, as indicated at 15, to receive the trigger 16, hammer assembly 17 and rebound cam assembly 18, and a separate slot 19, open forwardly and upwardly, receives the support cam 20 of the barrel 21.

The barrel is cylindrical, mounted centrally on the support cam 20 which is pivoted on the pin 22 in the slot 19, the cam having a radially disposed camming surface 23 adapted to receive the rounded end of plunger 24, constituting part of a double-acting spring assembly, for retention of the barrel in firing position. The surface 23 is lower than the axis of pin 22 and the force of plunger 24 has a somewhat tangential moment so that the barrel is positively urged toward the closed (firing) position.

The trigger 16 is pivotally mounted on the cross pin 25 and is shaped to have a stop lug 26, bearing normally against the front wall of the recess 15, a spring abutment 27 and a sear 28. The double-acting spring assembly lies mainly in a bore 30 extending downward from recess 15 to slot 19, and comprises the plunger 24 and compression spring 31 the rear end of which bears on the abutment 27, so that the assembly, at its rear end, urges the trigger towards its rest position and, at its forward end, holds the barrel in firing position.

Rearwardly of the abutment 27 the top of the sear 28 is provided with the upwardly facing stop lug 32, and a pear-shaped dog 33 is pivotally supported on the cross pin 34 in the forward part of the recess 15, close to the breech 13, the pin 34 and lug 32 being substantially in vertical alignment when the launcher is aimed horizontally. The arcuate bottom surface of the dog 33 lies close to the lug 32 and, in this position, the trigger cannot be moved.

The hammer assembly 17 is pivoted on the cross pin 35 and is formed with forwardly facing teeth 36, 37 each adapted to engage the end of the sear 28 and with rearwardly facing upper and lower seats 38, 39 for engagement by the rebound cam, as explained below. Upwardly, the hammer assembly comprises the cocking finger piece 40 and the firing pin 41, mounted in the front face of the hammer. The rearwardly projecting arm 34' acts as a stop to limit the extent of the cocking movement. The front face of the hammer is relieved, below the firing pin, to permit free rearward swinging movement of the dog 33 to the extent indicated in FIG. 3.

The breech portion 13 of the frame includes the breech block 42 and a face plate 43, both of which are traversed by the generally conical opening 44 through which the firing pin is projected in order to detonate a cartridge (not shown) in the rear end of the barrel.

The rebound cam assembly 18 comprises the bifurcated cam 45 having its spaced upper and lower ends 46, 47 seated in the seats 38, 39 on the rear of the hammer. The cam is mounted on the reduced front end of the cam strut 48, the reduced rear end 49 of which fits freely in a diametrical bore through the cylindrical strut bearing 51. The cam is urged forwardly by the compression spring 50, acting between the strut collar 52 at the rear of the cam and the surface of the spring strut bearing 51 which rests in the rear end of the frame cavity 15.

In the "at rest" or safety position of the parts, the sear is engaged (or nearly so) with the upper tooth 36, the cam ends 46, 47 rest in their respective seats 38, 39 and the point of the firing pin lies within the opening 44. The cam and hammer assemblies are in equilibrium and the firing pin is not urged forward; so long as the sear is in a position to engage the tooth 36, the firing pin cannot be forced forward.

In the operation of the launcher, without the safety feature of the present invention, a flare shell or the like is inserted in the barrel which is then closed, the hammer is cocked to engage the sear 28 with tooth 37 and the shell is fired by pulling the trigger, as usual.

In its cocked position the cam 45 engages the hammer only through the upper end 46 resting in seat 38 and arm 34' resting against the upper side of the cam. When the trigger is pulled to release the hammer, the latter reaches its greatest rotational velocity as it passes the position of rest (FIG. 1) so that it easily goes past that position by the few degrees necessary to permit the firing pin to traverse the opening and detonate the shell. At that point, however, the cam 45 is acting on the hammer only through the lower end 47 in seat 39, so that the cam causes the hammer to rebound, returning the firing pin immediately to its rest position. The trigger being released, tooth 36 is engaged (or nearly so) by the sear and the mechanism is in safe condition.

With the introduction of the gravity actuated dog 33, as shown in FIG. 1, the trigger cannot be moved to disengage the sear from the tooth 36, so that firing cannot take place in the normal manner. It may be possible to draw the hammer part way toward its cocked position, depending on the clearance between the sear and the back of tooth 37, but firing cannot be effected (even if the hammer could be cocked) as long as the sear is held in the path of the tooth 36.

Figure 2:
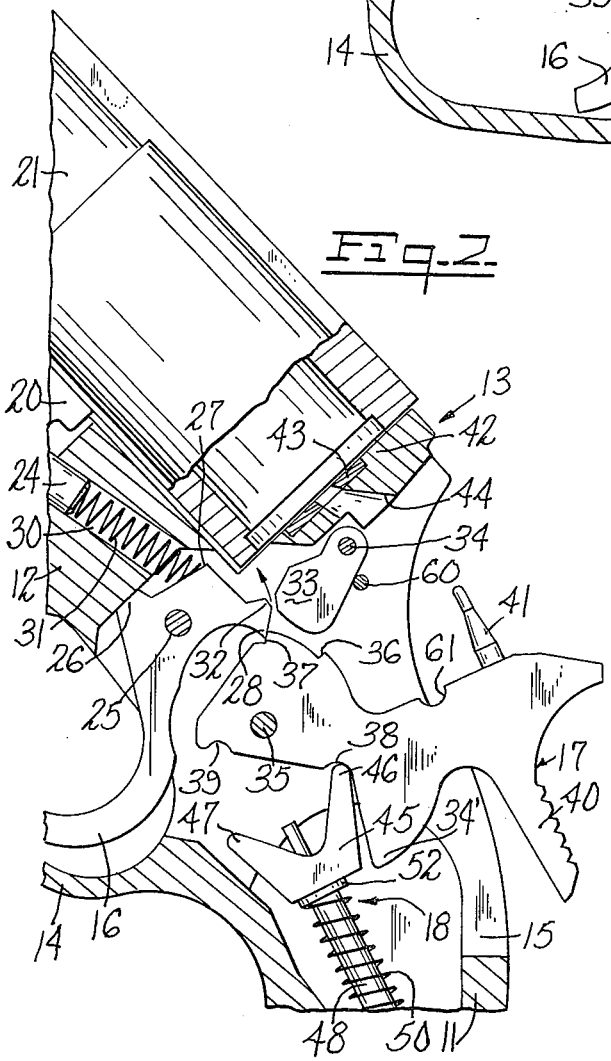
FIG. 2 represents a detail section, similar to FIG. 1, showing the hammer and trigger in cocked position, the launcher being aimed upward in condition for firing.
Figure 3:
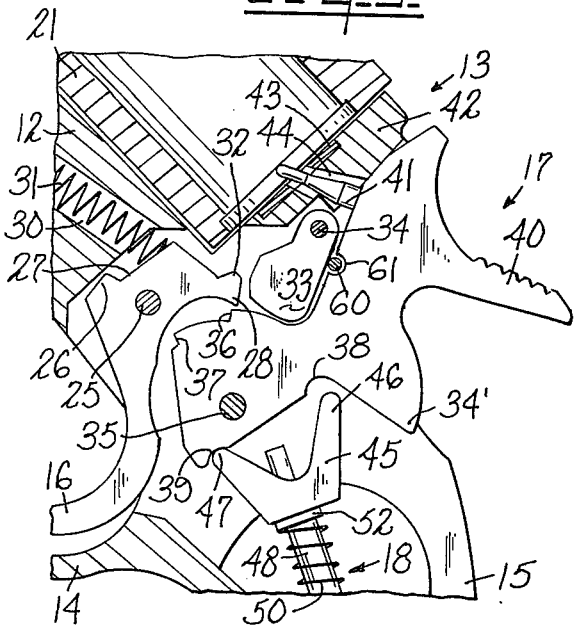
FIG. 3 represents a detail section, as in FIG. 2, showing the parts in the "fired" position.
Figure 4:
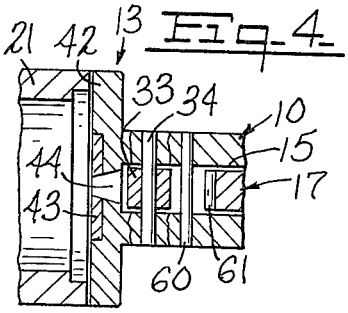
FIG. 4 represents a detail horizontal section on the line IV—IV of FIG. 1.

However, when the launcher is aimed upwardly, as in FIG. 2, the dog 33 swings out of the path of the lug 32, the hammer can be drawn back to full cocked position and a pull on the trigger will fire the shell (FIG. 3). The dog needs to swing only a few degrees, so that its rearward movement may be restricted, as by a stop pin 60, to hold it within the limits of the relieved front face of the hammer. A notch 61 may be formed in the hammer face to accommodate the stop pin, if necessary.

Rocking of the launcher around the barrel axis, in either direction, will not affect the functioning of the dog in either of its intended positions so long as the rocking is somewhat less than 90° either way.

As noted above, the hammer cannot be cocked when the dog is in its safety position. If the launcher should be elevated to its firing position and cocked, then returned to any altitude below 45°, it could not be fired because the dog would lock the sear in engagement with the tooth 37. Firing is prevented also in the unlikely event that the launcher might be loaded with the hammer cocked.

It will be appreciated that such a simple, pivotally supported dog, could be similarly associated with the trigger, sear and hammer of firearms differing in purpose and construction from the signal launcher shown herein.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

What we claim is:

1. In a firearm having a frame, a hammer pivotally mounted in the frame and having at least one tooth adapted to be engaged by a sear, a trigger pivotally mounted in the frame and having a sear adapted to engage the tooth on the hammer, means biasing the hammer toward firing position and means biasing the sear toward tooth engaging position, the improvement comprising a gravity responsive dog pivotally mounted in the frame at a point substantially above the sear when the firearm is aimed horizontally, the lower surface of the dog being located close enough to the sear to stop rotation of the trigger and sear out of tooth engaging position, means preventing the dog from swinging forward when the firearm is aimed downwardly, and clearance being provided to permit the dog to swing rearwardly away from the sear when the firearm is aimed upwardly.

2. A firearm according to claim 1 wherein the dog is pivotally mounted for rotation forward and rearward about a normally horizontal axis.

3. A firearm according to claim 1 wherein the frame includes a breech and wherein the pivotal mounting of the dog is adjacent to said breech.

4. A firearm according to claim 1 wherein the bottom surface of the dog is arcuate.

* * * * *